US009568851B2

(12) United States Patent
Murata et al.

(10) Patent No.: US 9,568,851 B2
(45) Date of Patent: Feb. 14, 2017

(54) IMAGE FORMING APPARATUS

(71) Applicant: Konica Minolta, Inc., Chiyoda-ku, Tokyo (JP)

(72) Inventors: Hisashi Murata, Toyohashi (JP); Kazuki Kobori, Toyokawa (JP); Hirohisa Shirai, Toyokawa (JP); Masato Kimura, Toyoake (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/053,253

(22) Filed: Feb. 25, 2016

(65) Prior Publication Data

US 2016/0252840 A1 Sep. 1, 2016

(30) Foreign Application Priority Data

Feb. 26, 2015 (JP) ..... 2015-036274

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS 5,606,399 A * 2/1997 Kikui ..... G03G 15/0216 399/168
2001/0019669 A1* 9/2001 Watanabe ..... G03G 15/0266 399/50
2003/0215253 A1* 11/2003 Okano ..... G03G 21/1889 399/50
2013/0064562 A1* 3/2013 Shibuya ..... G03G 15/0266 399/50
2015/0234338 A1* 8/2015 Murauchi ..... G03G 15/80 399/50
2016/0252838 A1* 9/2016 Kato ..... G03G 21/20
2016/0252839 A1* 9/2016 Kato ..... G03G 15/0266

FOREIGN PATENT DOCUMENTS

JP 2008-107605 A 5/2008

* cited by examiner

*Primary Examiner* — David Gray
*Assistant Examiner* — Tyler Hardman
(74) *Attorney, Agent, or Firm* — Buchanan Ingersoll & Rooney PC

(57) ABSTRACT

An image forming apparatus that forms an image on a medium includes: an image carrying member; a charging unit disposed in proximity to the image carrying member; a power supply unit configured to sequentially apply a plurality of charging voltages to the charging unit when the medium is not fed through; a current detecting unit configured to detect an AC value flowing through the charging unit; a processing unit configured to perform first charging voltage determination control to derive a peak-to-peak voltage value to be used in a process; and a storage unit configured to pre-store a reference peak-to-peak voltage value for each wastage level of the image carrying member, wherein the processing unit: prohibits execution of the first charging voltage determination control and performs second charging voltage determination control; and obtains a reference peak-to-peak voltage value and derives a peak-to-peak voltage value to be used in the process.

9 Claims, 12 Drawing Sheets

IMAGE FORMING APPARATUS

The entire disclosure of Japanese Patent Application No. 2015-036274 filed on Feb. 26, 2015 including description, claims, drawings, and abstract are incorporated herein by reference in its entirety.

BACKGROUND OF THE INVENTION

Field of the Invention

The present invention relates to an image forming apparatus including a charging unit of a proximity charging system to which a charging voltage having an AC voltage superimposed on a DC voltage is applied.

Description of the Related Art

In recent years, for a charging system for an image forming apparatus, a proximity charging system has become mainstream. In the proximity charging system, for example, a roller type charging unit is disposed in proximity to a photoconductor drum so as to contact or not to contact a surface of the photoconductor drum. A charging voltage having an AC voltage superimposed on a DC voltage is applied to the charging unit so that the surface of the photoconductor drum can be uniformly charged.

In the above-described image forming apparatus, a peak-to-peak voltage value Vpp of an AC voltage Vac to be superimposed on the charging voltage is derived by charging voltage determination control. Conventionally, this type of charging voltage determination control is described in, for example, JP 2008-107605 A. In JP 2008-107605 A, a peak-to-peak voltage value Vpp of an AC voltage Vac is derived by gradually increasing the peak-to-peak voltage value Vpp of the AC voltage Vac from an initial value until a current value detected by a current detecting unit is saturated. If the AC voltage Vac exceeds clamping voltage during this control, the peak-to-peak voltage value Vpp is set to an initial voltage. On the other hand, if a temperature and a humidity exceed their predetermined reference values, the peak-to-peak voltage value Vpp is set to a value smaller than a peak-to-peak voltage value Vpp that is obtained when one of the temperature and humidity is less than its reference value.

In JP 2008-107605 A, it is premised to use a photoconductor drum having a hard photoconductor film, e.g., an a-Si (amorphous silicon) photoconductor. Therefore, JP 2008-107605 A does not take into account changes in detected current value caused by wastage of the film thickness of the photoconductor drum.

If the photoconductor film is hard, it is disadvantageous to remove discharge products, etc., adhered to the surface of the photoconductor drum. Thus, it is desirable to use a photoconductor drum whose film thickness is wasted moderately during cleaning, etc. However, if the charging voltage determination control described in JP 2008-107605A is adopted when such a photoconductor drum is used, the current detecting unit may detect an inaccurate current value due to wastage of the film thickness, which may result in a control unit setting an inaccurate peak-to-peak voltage value Vpp.

SUMMARY OF THE INVENTION

An object of the present invention is therefore to provide an image forming apparatus capable of setting an appropriate AC peak-to-peak voltage value, irrespective of the wastage of the film thickness of an image carrying member.

To achieve the abovementioned object, according to an aspect, an image forming apparatus that forms an image on a medium when the medium is fed through the apparatus, the image forming apparatus reflecting one aspect of the present invention comprises: an image carrying member; a charging unit disposed in proximity to the image carrying member; a power supply unit configured to sequentially apply a plurality of charging voltages to the charging unit when the medium is not fed through, the plurality of charging voltages including AC voltages, respectively, and the AC voltages having different peak-to-peak voltages; a current detecting unit configured to detect an AC value flowing through the charging unit during the application of each of the plurality of charging voltages; a processing unit configured to perform first charging voltage determination control to derive a peak-to-peak voltage value to be used in a process, based on the AC values detected by the current detecting unit; and a storage unit configured to pre-store a reference peak-to-peak voltage value for each wastage level of the image carrying member, wherein the processing unit: prohibits execution of the first charging voltage determination control according to at least one AC value obtained from the current detecting unit, and performs second charging voltage determination control; and in the second charging voltage determination control, obtains a reference peak-to-peak voltage value associated with a current wastage level of the image carrying member from the storage unit, and derives a peak-to-peak voltage value to be used in the process, based on the obtained reference peak-to-peak voltage value.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of an image forming apparatus of the present invention will be described in detail with reference to the drawings. However, the scope of the invention is not limited to the illustrated examples.

<<First Section: Definitions>>

Some drawings show an x-axis, a y-axis, and a z-axis which intersect each other. The x-axis and the z-axis indicate a left-right direction and an up-down direction of an image forming apparatus 1. In addition, the y-axis indicates a front-back direction of the image forming apparatus 1.

<<Second Section: Overall Configuration and Printing Process of the Image Forming Apparatus>>

Figure 1:
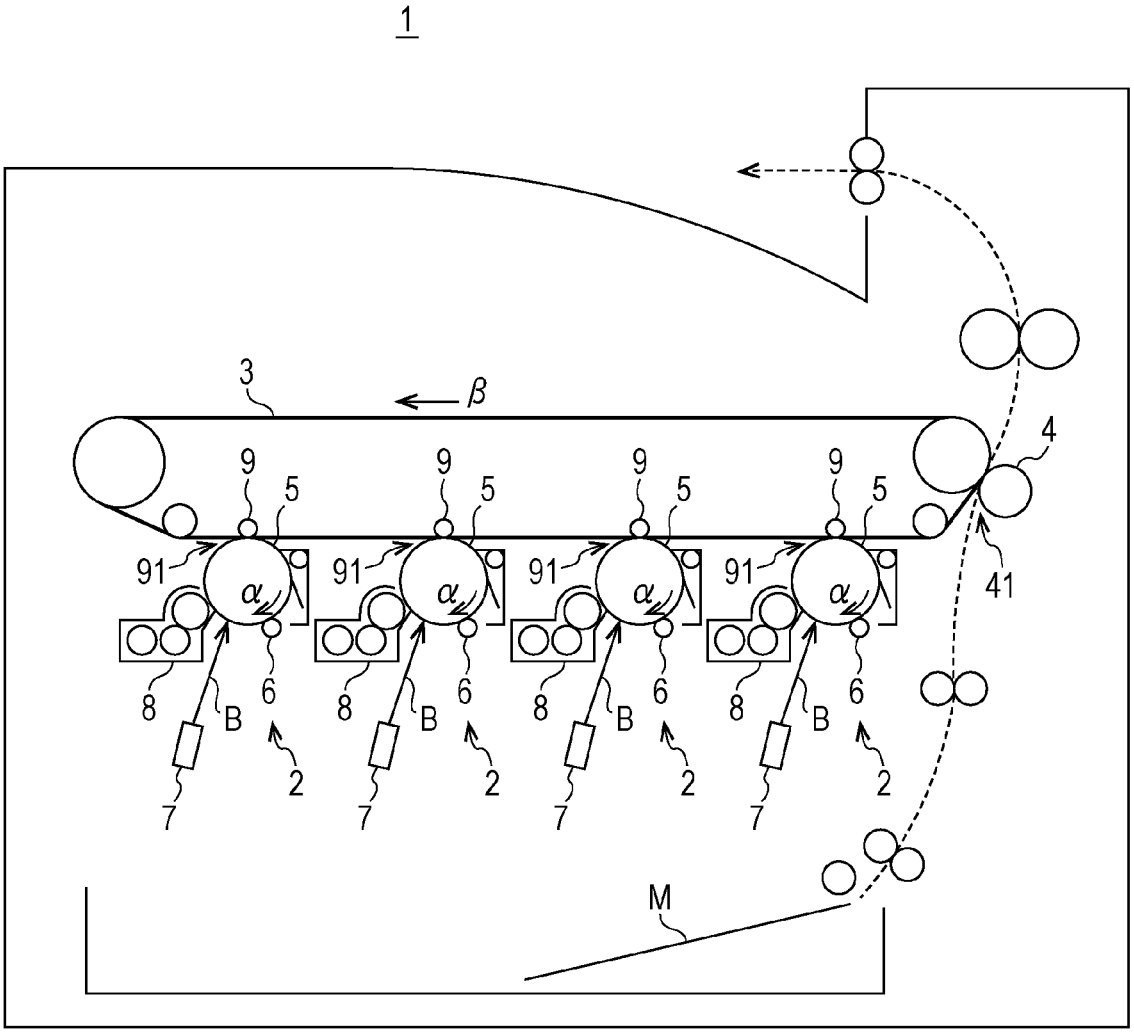
FIG. 1 is a schematic diagram showing a schematic configuration of an image forming apparatus.
Figure 1:
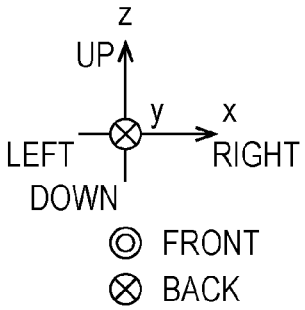
Figure 2:
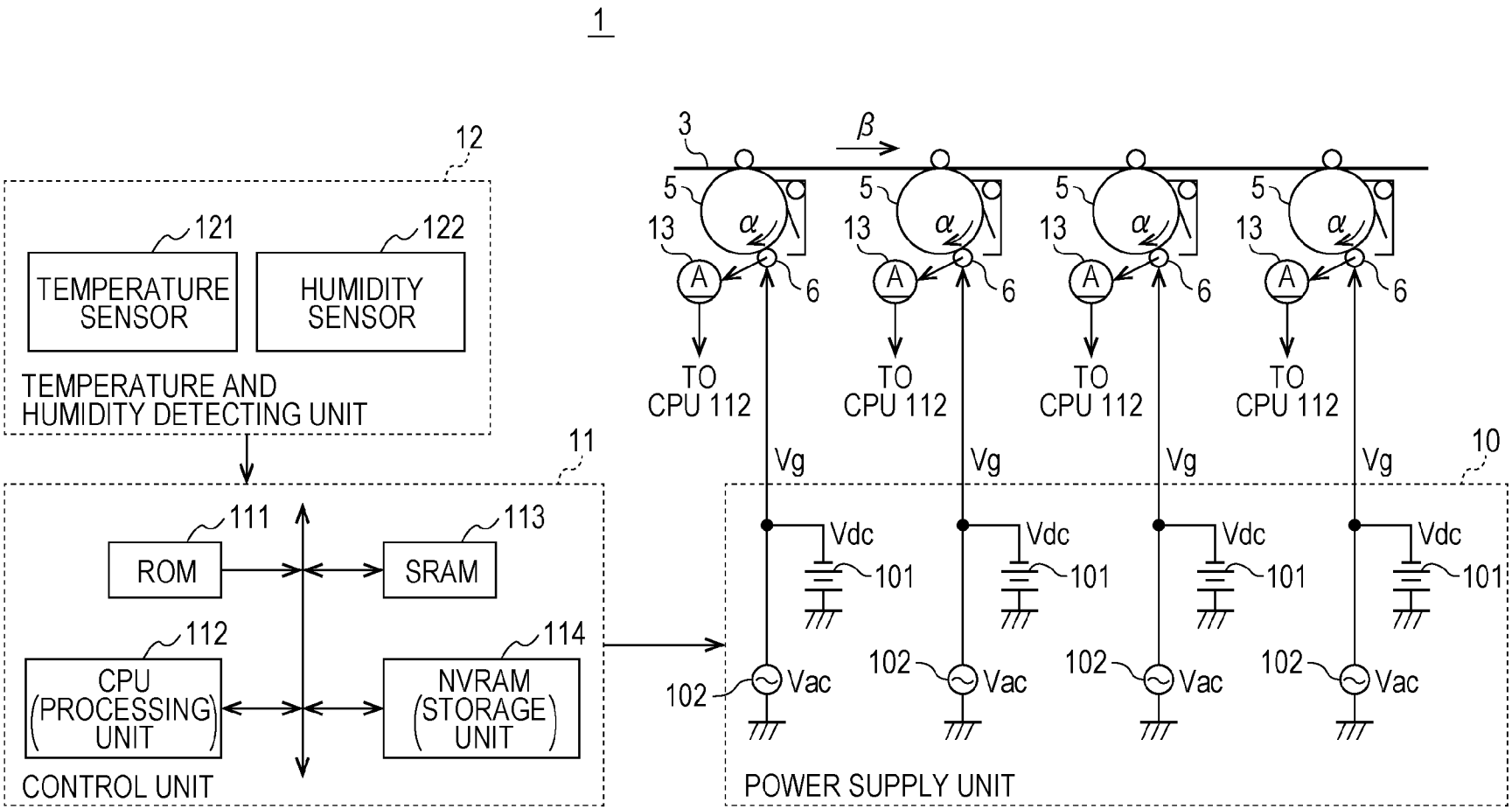
FIG. 2 is a schematic diagram showing a configuration of a main part of the image forming apparatus.

In FIGS. 1 and 2, the image forming apparatus 1 is, for example, a copier, a printer, or a facsimile, or a multifunctional peripheral having those functions. The image forming apparatus 1 forms various types of images (typically, full-color images or monochrome images) on a print medium (a sheet of paper or an OHP sheet) M by a known electrophotographic method and tandem method. Hence, the image forming apparatus 1 further includes image creating units 2 for respective colors, yellow (Y), magenta (M), cyan (C), and black (K), an intermediate transfer belt 3, a secondary transfer roller 4, a power supply unit 10, a control unit 11, a temperature and humidity detecting unit 12, and at least one current detecting unit 13.

The image creating units 2 for four colors are, for example, juxtaposed in the left-right direction and include photoconductor drums 5 for corresponding colors. Each photoconductor drum 5 has, for example, a cylindrical shape extending in the front-back direction, and rotates about its axis, for example, in a direction of arrow α.

Figure 3:
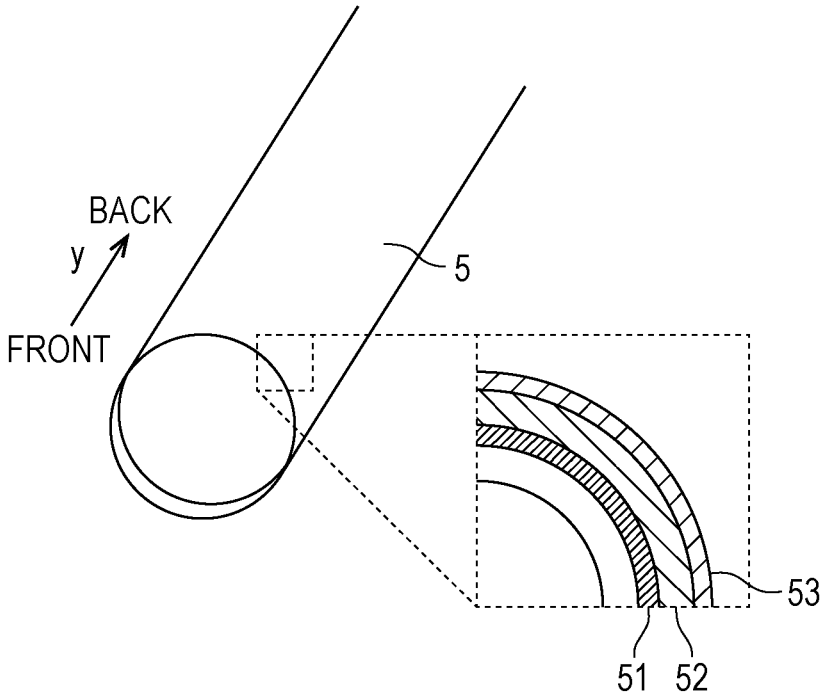
FIG. 3 is a schematic diagram showing a detailed configuration of a photoconductor drum of FIG. 1.

As exemplified in FIG. 3, the photoconductor drum 5 is preferably an organic photoconductor having a charge generation layer (hereinafter, referred to as CGL) 51, a charge transport layer (hereinafter, referred to as CTL) 52, and an overcoat layer (hereinafter, referred to as OCL) 53 which are stacked on top of each other in this order on an aluminum base extending in the front-back direction. Note that the photoconductor drum 5 does not necessary require the OCL 53.

Here, an α-value which is an index of how easily a surface of a photoconductor drum is scraped is defined as the amount of scrape (the amount of wear) per 100,000 rotations (μm). The α-values of various types of photoconductor drums are as shown in the following Table 1. Note that, for comparison, Table 1 also includes the α-value of a photoconductor drum made of amorphous silicon (a-Si). Photoconductor films such as the OCL 53 are scraped off as appropriate, by which discharge products, etc., are removed. When the α-value is too small, the photoconductor films are easily scraped off and accordingly discharge products, etc., may not be able to be removed securely. Therefore, in the present embodiment, the α-value of the photoconductor drums 5 preferably exceeds 0.5.

TABLE 1

The α-values of various types of photoconductor drums

| | a-Si photoconductor | With OCL 53 | Without OCL 53 |
|---|---|---|---|
| α-value | 0.5 | 1.2 | 3.0 |

FIGS. 1 and 2 are referred back. Around each photoconductor drum 5 are disposed at least a charging unit 6, a developing unit 8, and a primary transfer roller 9 from the upstream side to downstream side of the rotation direction α.

Each charging unit 6 is typically a charging roller which extends in the front-back direction and which is disposed in proximity to a corresponding photoconductor drum 5 so as to contact or not to contact an outer surface of the photoconductor drum 5. Each charging unit 6 allows the outer surface of the rotating photoconductor drum 5 to be charged uniformly by a charging voltage Vg from the power supply unit 10.

The power supply unit 10 includes, for each color, a set of a DC power supply circuit 101 and an AC power supply circuit 102.

Each DC power supply circuit 101 outputs a predetermined DC voltage Vdc under control of the control unit 11. The DC power supply circuits 101 are provided separately for the respective colors. By this, the DC voltage Vdc can be adjusted on a color-by-color basis. However, it is not a matter of interest in the present embodiment to change the DC voltage Vdc on a color-by-color basis. Thus, for convenience sake, description is continued such that the DC voltages Vdc have the same value for all colors.

In addition, each AC power supply circuit 102 is composed of, for example, an AC transformer and outputs an AC voltage Vac whose peak-to-peak voltage value Vpp is variable, under control of the control unit 11. Note that from the same viewpoint as the DC voltages Vdc, description is continued such that the AC voltages Vac have the same value.

An output terminal of each AC power supply circuit 102 is connected to an output terminal of a DC power supply circuit 101 for a corresponding color. By this, a charging voltage Vg having an AC voltage Vac superimposed on a DC voltage Vdc is generated and applied to a charging unit 6 for a corresponding color.

An exposure apparatus 7 is provided below each photoconductor drum 5. Each exposure apparatus 7 irradiates an exposure area which is on the immediately downstream side of a charging area of the photoconductor drum 5, with a light beam B generated based on image data. By this, an electrostatic latent image of a corresponding color is formed.

Each developing unit 8 supplies a developer of a corresponding color to a development area which is on the immediately downstream side of an exposure area of a photoconductor drum 5 for a corresponding color, and thereby forms a toner image of the corresponding color.

The intermediate transfer belt 3, for example, runs over outer surfaces of at least two rollers which are arranged in the left-right direction, and rotates, for example, in a direction indicated by arrow β. An outer surface of the intermediate transfer belt 3 abuts on, for example, a top of each photoconductor drum 5.

Each primary transfer roller 9 faces a photoconductor drum 5 for a corresponding color with the intermediate transfer belt 3 sandwiched therebetween, and presses the intermediate transfer belt 3 from above and thereby forms a primary transfer nip 91 between the photoconductor drum 5 and the intermediate transfer belt 3. During a printing process, a primary transfer bias voltage is applied to each primary transfer roller 9. As a result, the toner images on the photoconductor drums 5 are transferred onto the rotating intermediate transfer belt 3 by the corresponding primary transfer nips 91.

The secondary transfer roller 4 is formed so as to be rotatable about its axis. During a printing process, a secondary transfer bias voltage is applied to the secondary transfer roller 4. The secondary transfer roller 4 presses the outer surface of the intermediate transfer belt 3, for example, near a right end of the intermediate transfer belt 3, and thereby forms a secondary transfer nip 41 at a contact portion between the secondary transfer roller 4 and the intermediate transfer belt 3. During a printing process, the print medium M is fed into the secondary transfer nip 41.

While the print medium M is passing through (i.e., being fed through) the secondary transfer nip 41, a secondary transfer bias voltage is applied to the secondary transfer roller 4. Thus, the toner images carried on the intermediate transfer belt 3 are moved and transferred onto the print medium M. After the print medium M passes through the secondary transfer nip 41, the print medium M passes through a known fuser and is then discharged as a printed matter to a tray.

The control unit 11 includes, for example, a ROM 111, a CPU 112 which is an example of a processing unit, an SRAM 113, and an NVRAM 114 which is an example of a storage unit. The CPU 112 controls various types of processes by executing a control program which is pre-stored in the ROM 111, using the SRAM 113 as a work area. The present embodiment is particularly related to the following four processes (i.e., printing, image stabilization, forced toner replenishment, and TCR adjustment). Since the photoconductor drums 5 need to be charged in the following four processes, too, charging voltages Vg are applied to the charging units 6.

(1) Printing: to form an image on the print medium M (2) Image stabilization: to control toner density to a target value based on the density of a known pattern image (3) Forced toner replenishment: to forcefully replenish the developing units 8 with toner (4) TCR adjustment: to control the ratio between toner and carrier to a target value In addition to the above, the CPU 112 further performs either one of first charging voltage determination control and second charging voltage determination control which will be described later, to determine a peak-to-peak voltage value Vpp which is to be used in each of the above-described processes and which is a reference value of an AC voltage Vac to be superimposed on a charging voltage Vg (hereinafter, referred to as the reference peak-to-peak voltage Vpp0). In addition, in order to determine a peak-to-peak voltage Vpp of an AC voltage Vac that is actually superimposed in each of the above-described processes (hereinafter, referred to as the actual peak-to-peak voltage Vpp1), the CPU 112 holds in the NVRAM 114 a current total number of printed pages S in the image forming apparatus 1, as an example of wastage level information Iwst indicating the wastage level of the film thickness of each photoconductor drum 5 (see the following Table 2). Note that, though details will be revealed later, attention needs to be paid to the fact that in the present embodiment the reference peak-to-peak voltage value Vpp0 differs from the actual peak-to-peak voltage Vpp1.

TABLE 2

| Wastage level information Iwst | |
|---|---|
| Color | Total number of printed pages S |
| Y | 85,000 pages |
| M | 85,000 pages |
| C | 85,000 pages |
| K | 100,000 pages |

The temperature and humidity detecting unit 12 includes a temperature sensor 121 and a humidity sensor 122. The temperature sensor 121 detects a temperature inside the image forming apparatus 1 (i.e., an in-device temperature) St and outputs the temperature to the CPU 112. On the other hand, the humidity sensor 122 detects a relative humidity inside the image forming apparatus 1 (hereinafter, referred to as the in-device humidity) Sh and outputs the relative humidity to the CPU 112.

In addition, each current detecting unit 13 detects an AC value Iac flowing through a corresponding photoconductor drum 5 when a charging voltage Vg is applied to a corresponding charging unit 6, and outputs the AC value Iac to the CPU 112. The current detecting unit 13 includes an ammeter or a current detection sensor.

<<Third Section: Operation of the Image Forming Apparatus>>

Next, with reference to FIGS. 4A to 7, operation of the image forming apparatus 1 will be described.

Figure 4A:
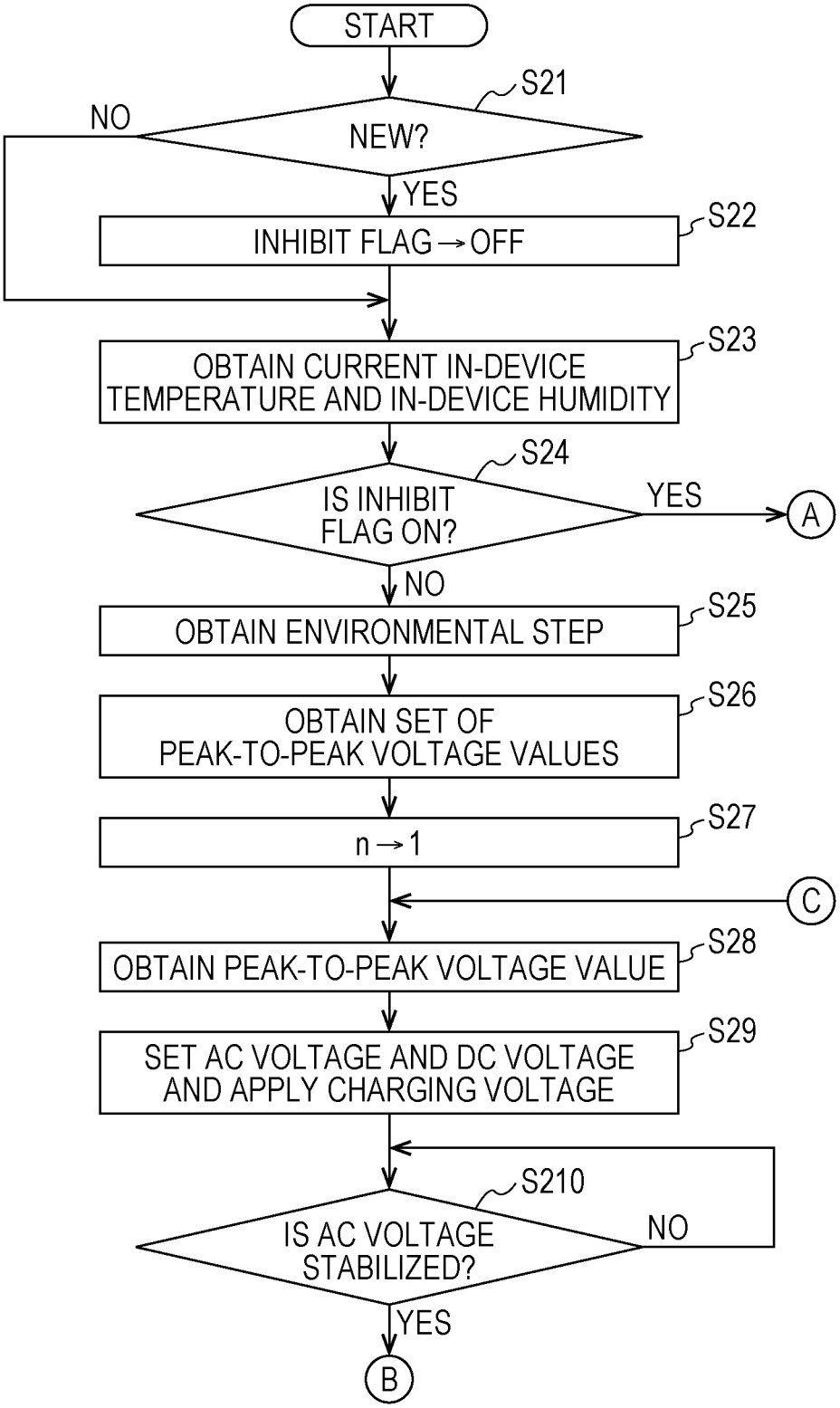
FIG. 4A is a flowchart showing the first half part of a process performed by a CPU during charging voltage determination control.

In FIG. 4A, when the CPU 112 determines charging voltage determination control in the above-described four processes, in a state in which the print medium M is not transported into the image forming apparatus 1 (i.e., in a state in which the print medium M is not fed through), first, the CPU 112 determines, for a photoconductor drum 5 for a certain color, whether each photoconductor drum 5 is new, by a known technique (S21). If a positive determination is made (i.e., if "Y"), the CPU 112 turns off an prohibit flag for each color (details will be described later) (S22). On the other hand, if a negative determination is made (i.e., if "N"), the CPU 112 skips S22.

After S22 or if the determination at S21 is "N", the CPU 112 obtains a current in-device temperature St and in-device humidity Sh from the temperature and humidity detecting unit 12 (S23). Then, the CPU 112 determines whether the prohibit flag for each color is on (S24). In the following, first, the case of "off" will be described. In this case, the CPU 112 obtains an environmental step associated with the in-device temperature St and the in-device humidity Sh which are obtained at S23, from an environmental step table T1 which is held in advance in the ROM 111 or the NVRAM 114 (S25). In the table T1, as shown in the following Table 3, an environmental step which is an index indicating the magnitude of absolute humidity is provided for each combination of in-device temperature and in-device humidity. This table T1 is created in advance by experiment, etc., at a manufacturing stage or a development stage of the image forming apparatus 1. In this regard, the same also applies to other tables. In the present embodiment, the environmental steps are classified into 16 steps. Environmental steps 1 to 3 indicate a low-temperature and low-humidity environment (so-called LL environment), environmental steps 4 to 7 indicate a normal-temperature and normal-humidity environment (so-called NN environment), environmental steps 8 to 12 indicate a slightly high-temperature and high-humidity environment, and environmental steps 13 to 16 indicate a high-temperature and high-humidity environment (so-called HH environment).

TABLE 3

Environmental step table T1

| | | In-device temperature (° C.) | | | | | | |
|---|---|---|---|---|---|---|---|---|
| | | <15 | <20 | <24 | <28 | <32 | <44 | 44≥ |
| In-device humidity (%) | <18 | 1 | 1 | 1 | 2 | 2 | 2 | 2 |
| | <32 | 2 | 2 | 2 | 2 | 3 | 4 | 6 |
| | <55 | 3 | 5 | 5 | 7 | 7 | 8 | 9 |
| | <65 | 4 | 5 | 7 | 7 | 8 | 9 | 10 |
| | <75 | 6 | 6 | 7 | 8 | 9 | 10 | 11 |
| | <85 | 8 | 8 | 9 | 9 | 11 | 12 | 14 |
| | 85≥ | 10 | 11 | 12 | 13 | 14 | 15 | 16 |

Then, the CPU 112 selects one set of peak-to-peak voltage values Vpp associated with the environmental step which is obtained at S25, from a peak-to-peak voltage value table T2 which is held in advance in the NVRAM 114 or the like (S26). In the table T2, as shown in the following Table 4, a set of eight different peak-to-peak voltage values Vpp is provided for each environmental step range. Each set includes four peak-to-peak voltage values Vpp for each of a forward discharge region and a reverse discharge region. In this specification, a region of peak-to-peak voltages Vpp (described later) where the peak-to-peak voltage value Vpp is less than 2×Vth (see FIG. 6) and where, when a charging voltage Vg is applied to the charging unit 6, charge movement only in a single direction from the charging unit 6 to the photoconductor drum 5 occurs, is referred to as the forward discharge region. On the other hand, a region where the peak-to-peak voltage value Vpp is greater than or equal to 2×Vth (see FIG. 6) and charge movement in two directions occurs alternately between the photoconductor drum 5 and the charging unit 6 is referred to as the reverse discharge region. In addition, Vth is a charging start voltage value at which charging of the photoconductor drum 5 starts by a DC voltage Vdc, and is determined by various characteristics of the photoconductor drum 5.

For example, environmental steps 1 to 3 are assigned a set A of peak-to-peak voltage values Vpp. The set A includes 600 V, 700 V, 800 V, and 900 V which are included in the forward discharge region, and 1850 V, 1950 V, 2050 V, and 2150 V which are included in the reverse discharge region. Environmental steps 4 to 7, 8 to 12, and 13 to 16 are assigned sets B, C, and D of peak-to-peak voltage values Vpp as shown in Table 4.

TABLE 4

Peak-to-peak voltage value table T2

| | | Environmental step | | | |
|---|---|---|---|---|---|
| | n | 1 to 3 (Set A) | 4 to 7 (Set B) | 8 to 12 (Set C) | 13 to 16 (Set D) |
| Set of peak-to-peak voltage values | 1 | 600 | 600 | 600 | 600 |
| | 2 | 700 | 700 | 700 | 700 |
| | 3 | 800 | 800 | 800 | 800 |
| | 4 | 900 | 900 | 900 | 900 |
| | 5 | 1850 | 1800 | 1750 | 1700 |
| | 6 | 1950 | 1900 | 1850 | 1800 |
| | 7 | 2050 | 2000 | 1950 | 1900 |
| | 8 | 2150 | 2100 | 2050 | 2000 |

Then, the CPU 112 initializes a first counter value n to 1 (S27), and obtains a peak-to-peak voltage value Vpp in the selected set that corresponds to the current first counter value n (S28).

The CPU 112 sets a peak-to-peak voltage value Vpp of an AC voltage Vac to be outputted from each of the AC power supply circuits 102 for the respective colors, to the value obtained at S28. In addition, the CPU 112 sets a DC voltage Vdc to be outputted from each of the DC power supply circuits 101 for the respective colors, to a predetermined value (S29).

As a result of S29, a charging voltage Vg is applied to each of the charging units 6 for the respective colors from the power supply unit 10. If the AC voltage Vac of each AC power supply circuit 102 is stabilized (S210), the CPU 112 initializes a second counter value m to 1 (FIG. 4B; S211). Then, the CPU 112 obtains an AC value Iac from each of the current detecting units 13 for the respective colors, and stores the obtained AC values Iac in the SRAM 113 on a color-by-color basis (S212).

Then, the CPU 112 determines whether the second counter m is "y" (S213). Here, "y" is the number of samples per rotation of each photoconductor drum 5 and is a natural number greater than or equal to 1. If a negative determination is made at S213, the CPU 112 increments the second counter value m by 1 (S214) and performs S212.

By repeating the above S211 to S214, the SRAM 113 holds AC values Iac for each color which are measured at y different locations in a circumferential direction while the photoconductor drum 5 for each color makes a single rotation. If a positive determination is made at S213, the CPU 112 derives an average value of the y AC values Iac and stores the average value in the SRAM 113 (S215).

In the present embodiment, S211 to S215 take into account variations in the film thickness of each photoconductor drum 5. Namely, the CPU 112 takes an average value of y AC values Iac which are obtained at a plurality of different locations in the circumferential direction while each photoconductor drum 5 makes a single rotation. By this, variations in the film thickness of each photoconductor drum 5 are smoothed.

Then, the CPU 112 subtracts an average value derived at S215 performed last time from the average value derived at S215 performed this time (i.e., just before), and thereby derives a difference value ΔIac (S216). Note that the last average value is not available for S216 performed for the first time, and thus, for convenience sake, for example, S216 is performed with the last average value being 0.

Then, the CPU 112 determines whether the difference value ΔIac obtained at S216 is less than or equal to a predetermined threshold value ΔIth (S217). Here, details of the threshold value ΔIth will be described later.

If the determination at S217 is "N", the CPU 112 determines whether the first counter value n is 8, and thereby determines whether the processes at S28 to S217 have been performed for all the peak-to-peak voltage values Vpp included in the set selected at S26 (S218). If the determination at S218 is "N", the CPU 112 increments the first counter value n by 1 (S219) and performs S28 of FIG. 4A.

By the above S28 to S219, the SRAM 113 obtains a total of eight AC values Iac flowing through each charging unit 6 when charging voltages Vg are sequentially applied. The charging voltages Vg have AC voltages Vac superimposed thereon. The AC voltages Vac have peak-to-peak voltage values Vpp, four of which are included in the forward discharge region and the other four of which are included in the reverse discharge region. The CPU 112 holds, for each color, in the SRAM 113 eight combinations, each including the peak-to-peak voltage value Vpp used at S29 and the AC value (average value) Iac obtained at S215. Here, in the following, the combinations of the peak-to-peak voltage value Vpp and the AC value Iac which are held in the SRAM 113 are generically written as (Vpp, Iac). In addition, when any of n=1 to 8 is individually written, it is written as (Vppj, Iacj). Here, j is a natural number of 1, 2, . . . 8.

The CPU 112 performs first charging voltage determination control based on (Vpp, Iac) for each color and thereby derives, for each color, a reference peak-to-peak voltage value Vpp0 to be used in various types of processes, etc., and stores the reference peak-to-peak voltage values Vpp0 in the NVRAM 114 (S220).

Now, with reference to FIGS. 5 and 6, the first charging voltage determination control will be described in detail.

Figure 5:
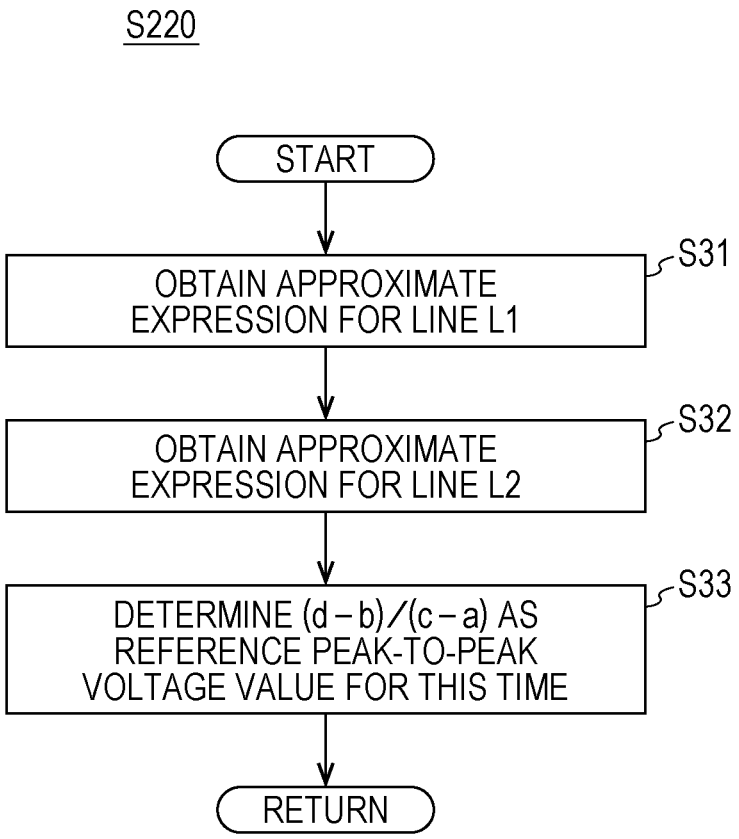
FIG. 5 is a flowchart showing a detailed process at S220 of FIG. 4B performed by the CPU.
Figure 6:
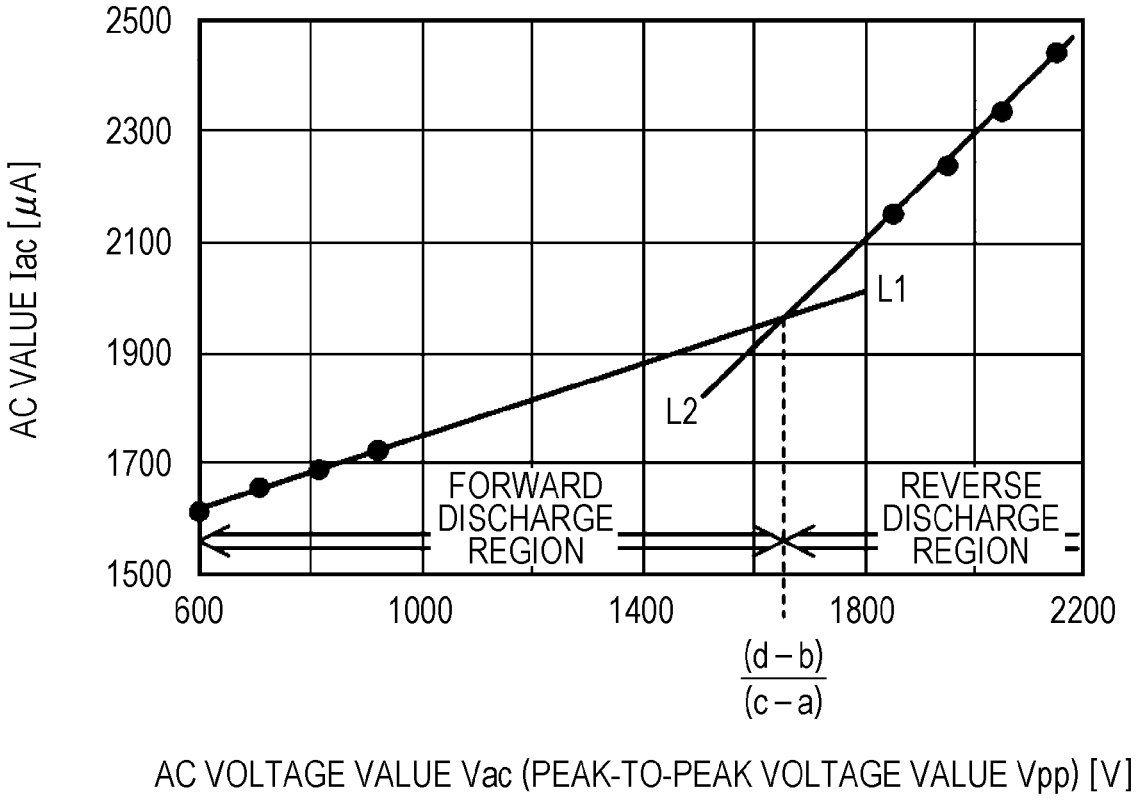
FIG. 6 is a diagram showing the content of processes at S31 to S33 of FIG. 5.

First, in FIGS. 5 and 6, the CPU 112 selects, for each color, four combinations of (Vpp, Iac) belonging to the forward discharge region, performs a linear approximation of data of the four combinations by a method of least squares, and thereby obtains a characteristic line L1 of the AC values Iac with respect to the applied AC voltage values Vac in the forward discharge region (Iac=a×Vac+b) (see FIG. 6) (S31).

Then, by the same technique, the CPU 112 performs, for each color, a linear approximation of four combinations (Vpp, Iac) belonging to the reverse discharge region, and thereby obtains a characteristic line L2 of the AC values Iac with respect to the applied AC voltage values Vac in the reverse discharge region (Iac=c×Vac+d) (see FIG. 6) (S32).

Here, a to d are constants. Particularly, c−a is a slope and b and d are intercepts, and a and b are derived from the following equations (1) and (2). From the same equations, c and d can also be derived.

[Equation 1]

$$a = \frac{4 \cdot \sum_{j=1}^{4} V_{ppj} \cdot I_{acj} - \sum_{j=1.}^{4} V_{ppj} \cdot \sum_{j=1}^{4} I_{acj}}{4 \cdot \sum_{j=1}^{4} V_{ppj}^2 - \left(\sum_{j=1}^{4} V_{ppj}\right)^2} \quad (1)$$

-continued

[Equation 2]

$$b = \frac{4 \cdot \sum_{j=1}^{4} V_{ppj}^2 \cdot \sum_{j=1}^{4} I_{acj} - \sum_{j=1.}^{4} V_{ppj} I_{acj} \cdot \sum_{j=1}^{4} V_{ppj}}{4 \cdot \sum_{j=1}^{4} V_{ppj}^2 - \left(\sum_{j=1}^{4} V_{ppj}\right)^2} \quad (2)$$

Then, the CPU 112 performs first charging voltage determination control and thereby derives, for each color, a Vpp value at an intersection point (=(d−b)/(c−a)) of the characteristic lines L1 and L2 which are obtained at S31 and S32. Then, the CPU 112 determines (d−b)/(c−a) which is derived for each color, as a reference peak-to-peak voltage value Vpp0 for charging voltage determination control for this time (S33).

Figure 4B:
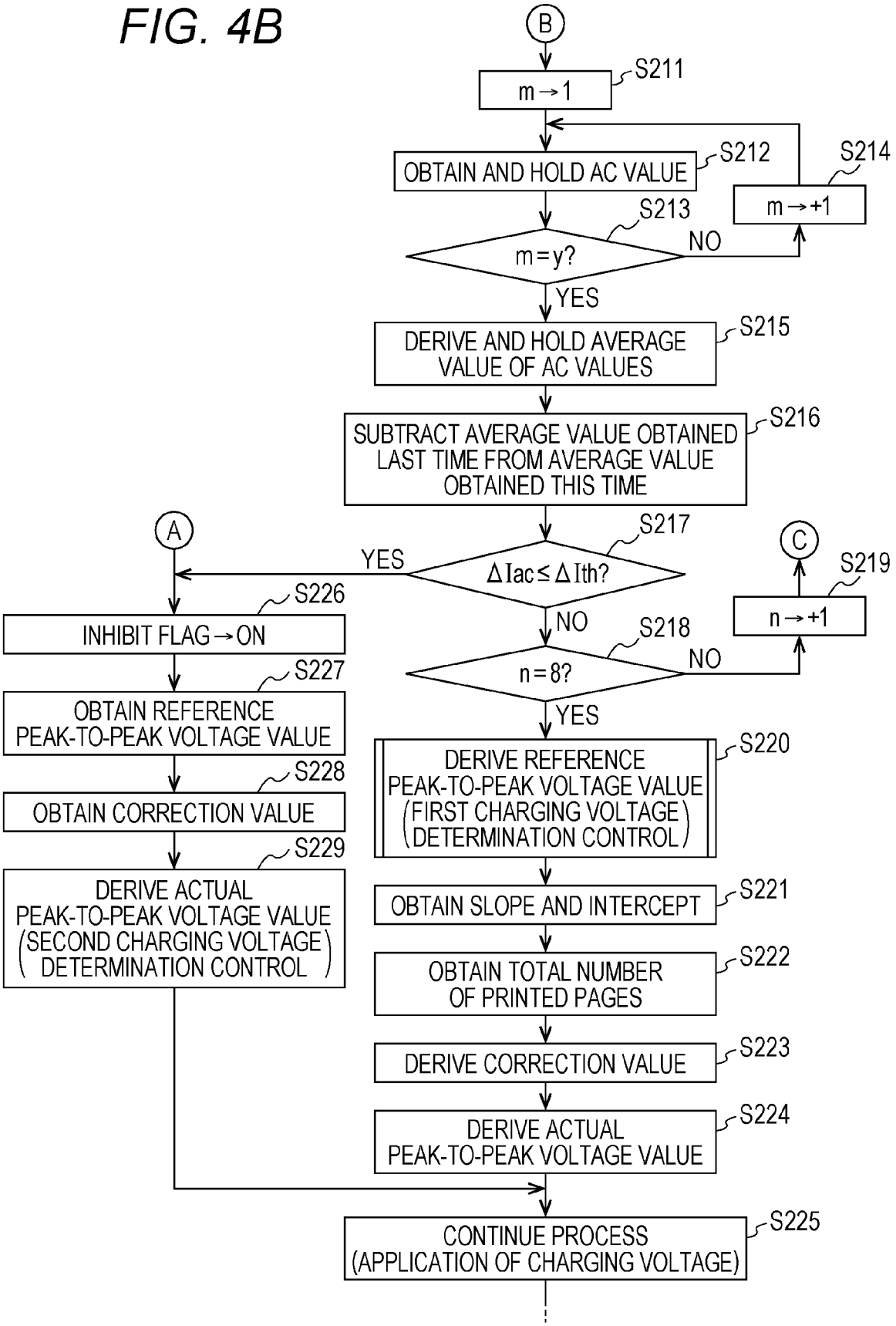
FIG. 4B is a flowchart showing the second half part of the process performed by the CPU during charging voltage determination control.

When the above S33 is finished, the CPU 112 leaves the process of FIG. 5 (i.e., finishes S220 of FIG. 4B) and performs S221 of FIG. 4B. Since the reference peak-to-peak voltage values Vpp0 stored at S220 are values based on the environmental step, it is hard to say that the reference peak-to-peak voltage values Vpp0 meet the current environmental conditions with high accuracy. Hence, the CPU 112 selects one set of a slope and an intercept associated with the in-device temperature St and the in-device humidity Sh which are obtained at S23, from a correction value table T3 which is held in advance in the NVRAM 114 or the like (S221). In the correction value table T3, as shown in Table 5, a set of a slope and an intercept is provided for each combination of a temperature range and a relative humidity range. For example, when the in-device humidity Sh is lower than 20% and the in-device temperature St is 10.5° C. or higher and lower than 12.5° C., (−0.0054, 269) are provided as (slope, intercept).

TABLE 5

Correction value table T3

| | Temperature At or higher than | | | | | | | | | | | |
|---|---|---|---|---|---|---|---|---|---|---|---|---|
| | | 10.5 | 12. 5 | 14.5 | 16.5 | 18.5 | 20.5 | 22.5 | 24.5 | 26. 5 | 28. 5 | 30.5 |
| | Lower than | | | | | | | | | | | |
| | 10.5 | 12.5 | 14.5 | 16.5 | 18. 5 | 20. 5 | 22.5 | 24.5 | 26.5 | 28. 5 | 30. 5 | |
| Relative humidity of lower than 20% | | | | | | | | | | | | |
| Slope | −0.0054 | −0.0054 | −0.0054 | −0.0054 | −0.0054 | −0.0054 | −0.0054 | −0.0054 | −0.0054 | −0.0054 | −0.0054 | −0.0054 |
| Inter-cept | 273 | 269 | 254 | 242 | 232 | 222 | 214 | 206 | 199 | 193 | 187 | 181 |
| Relative humidity of 20% or higher and lower than 50% | | | | | | | | | | | | |
| Slope | −0.0054 | −0.0054 | −0.0054 | −0.0054 | −0.0054 | −0.0054 | −0.0054 | −0.0054 | −0.0054 | −0.0054 | −0.0054 | −0.0054 |
| Inter-cept | 255 | 243 | 236 | 227 | 219 | 216 | 209 | 203 | 198 | 193 | 188 | 184 |
| Relative humidity of 50% or higher and lower than 80% | | | | | | | | | | | | |
| Slope | −0.0054 | −0.0054 | −0.0054 | −0.0054 | −0.0054 | −0.0054 | −0.0054 | −0.0054 | −0.0054 | −0.0054 | −0.0054 | −0.0054 |

TABLE 5-continued

| Correction value table T3 | | | | | | | | | | | | |
|---|---|---|---|---|---|---|---|---|---|---|---|---|
| | Temperature At or higher than | | | | | | | | | | | |
| | | 10.5 | 12. 5 | 14.5 | 16.5 | 18.5 | 20.5 | 22.5 | 24.5 | 26. 5 | 28. 5 | 30.5 |
| | Lower than | | | | | | | | | | | |
| | 10.5 | 12.5 | 14.5 | 16.5 | 18. 5 | 20. 5 | 22.5 | 24.5 | 26.5 | 28. 5 | 30. 5 | |
| Inter-cept | 220 | 215 | 212 | 208 | 205 | 203 | 200 | 198 | 196 | 193 | 192 | 190 |
| Relative humidity of 80% or higher | | | | | | | | | | | | |
| Slope | −0.0054 | −0.0054 | −0.0054 | −0.0054 | −0.0054 | −0.0054 | −0.0054 | −0.0054 | −0.0054 | −0.0054 | −0.0054 | −0.0054 |
| Inter-cept | 220 | 215 | 212 | 208 | 205 | 203 | 200 | 198 | 196 | 193 | 192 | 190 |

Then, the CPU 112 obtains a total number of printed pages for each color from the wastage level information Iwst in the NVRAM 114 (S222).

Then, the CPU 112 derives a correction value based on the following equation (3) (S223).

$$\text{Correction value} = \text{slope} \times \text{number of rotations} + \text{intercept} \quad (3)$$

Then, the CPU 112 adds together each reference peak-to-peak voltage value Vpp0 derived at S220 and the correction value for a corresponding color, and thereby derives an actual peak-to-peak voltage value Vpp1 that meets the current environmental conditions (i.e., temperature and relative humidity) with high accuracy (S224).

When the actual peak-to-peak voltage values Vpp1 are derived in the above-described manner, the CPU 112 sets peak-to-peak voltage values Vpp of AC voltages Vac to be outputted from the AC power supply circuits 102, to Vpp1 derived at S224, and sets DC voltages Vdc to be outputted from the DC power supply circuits 101, to a predetermined value. As a result, charging voltages Vg are applied to the charging units 6 from the power supply unit 10, by which the photoconductor drums 5 are charged (S225).

Meanwhile, an AC value Iac that can be detected by the current detecting units 13 has an upper limit value Ilimit. In first charging voltage determination control, when all detected AC values Iac do not exceed the upper limit value Ilimit, reference peak-to-peak voltage values Vpp0 can be derived appropriately (see the top in FIG. 7). On the other hand, when the AC voltage value Vac in the reverse discharge region is increased, the detected AC values Iac may be saturated at the upper limit value Ilimit and thus may not follow the AC voltage values Vac (see the middle in FIG. 7). If first charging voltage determination control is performed in such a state, the slope of the characteristic line L2 decreases and thus the Vpp value at the intersection point (=(d−b)/(c−a)) becomes smaller than the actual one. In this case, there is a possibility that an image defect caused by fogging toner may occur in a printed matter.

Figure 7:
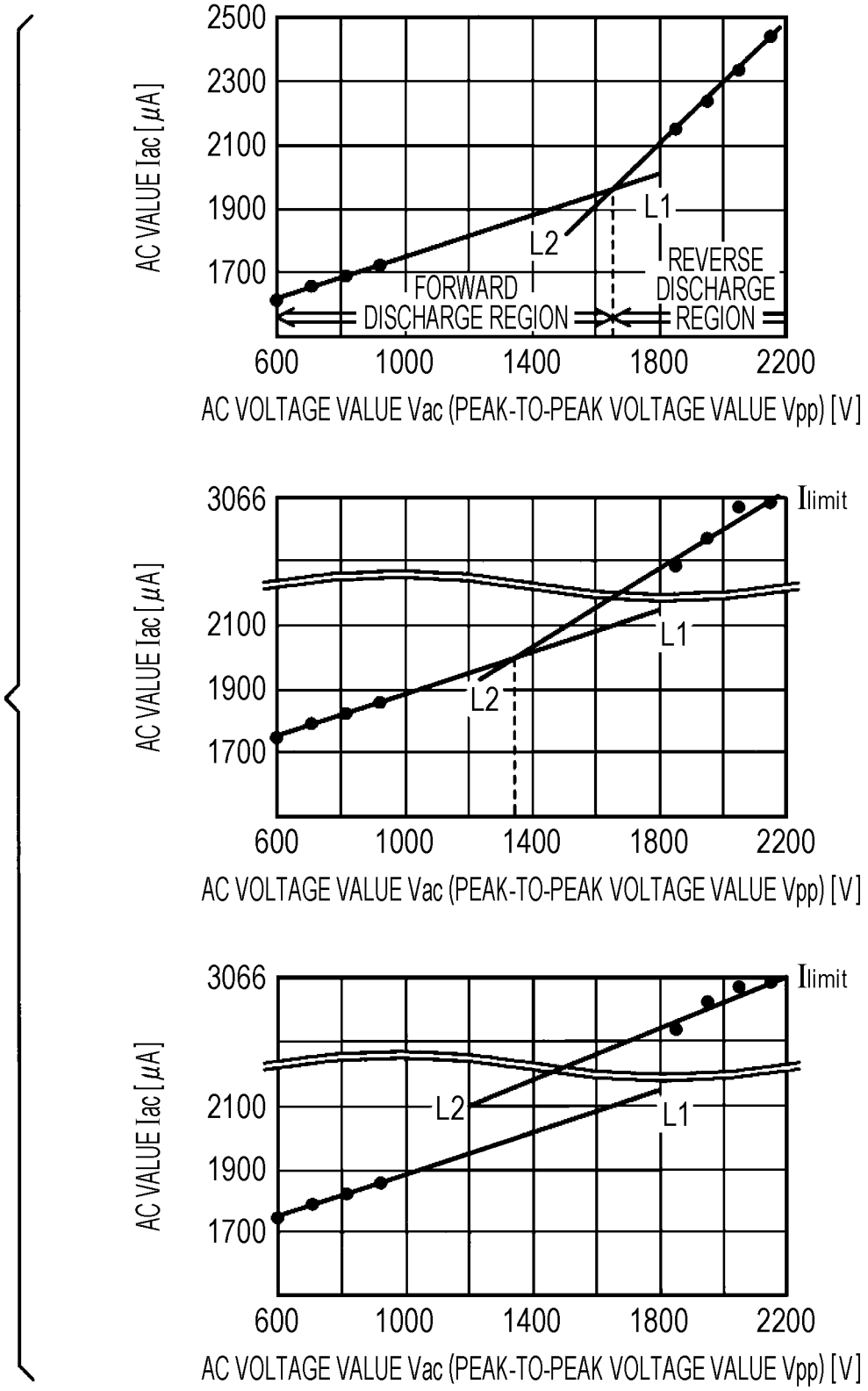
FIG. 7 is a diagram showing a relationship between an AC value detected by a current detecting unit and a reference peak-to-peak voltage.

In addition, if many AC values Iac in the reverse discharge region are saturated at the upper limit value Ilimit, the Vpp value at the intersection point itself may not be able to be derived (see the bottom in FIG. 7).

To cope with the above-described problems, it is considered to replace the current detecting units 13 with ones with a larger upper limit value Ilimit. However, the current detecting units with a larger upper limit value Ilimit not only increase cost, but also increase variations in AC value Iac to be detected in first charging voltage determination control (see the top in FIG. 8). Accordingly, the accuracy of a peak-to-peak voltage value Vpp to be derived decreases.

Figure 8:
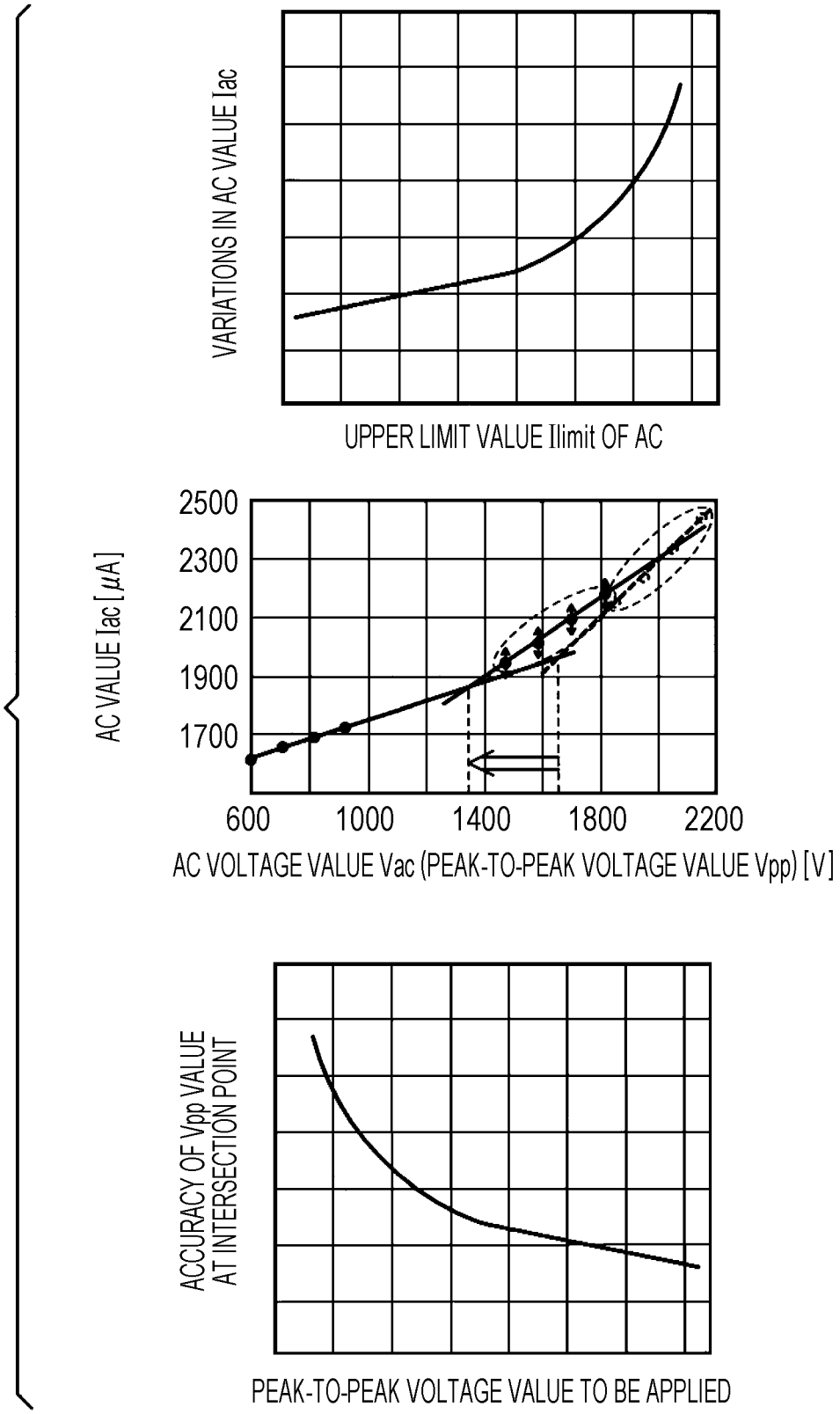
FIG. 8 is a diagram showing examples of alternatives to the current detecting unit and a problem thereof.

Other than that, there is also a method in which in order that an AC value Iac to be detected does not exceed the upper limit value Ilimit, of AC voltage values Vac to be applied in first charging voltage determination control, at least AC voltage values Vac that belong to the reverse discharge region are reduced (see the middle in FIG. 8). However, if the AC voltage values Vac in the reverse discharge region are reduced, a slope c of the characteristic line L2 tends to decrease. Furthermore, combined with variations in AC value Iac to be detected, variations in the slope c also increase. As a result, the Vpp value at the intersection point of the characteristic lines L1 and L2 also greatly varies, resulting in a decrease in the accuracy of a peak-to-peak voltage value Vpp to be derived (see the bottom in FIG. 8).

In addition, due to the use of the photoconductor drum 5, the film thickness is wasted, decreasing the resistance value of the photoconductor drum 5. Therefore, even if the same AC voltage value Vac is applied, an AC value Iac flowing through the charging unit 6 in proximity to the photoconductor drum 5 varies depending on the wastage level of the photoconductor drum 5. Accordingly, if the wastage of the photoconductor drum 5 proceeds too far, an AC value Iac detected by the current detecting unit 13 may be saturated at the upper limit value Ilimit with the application of a large AC voltage value Vac. Even if first charging voltage determination control is performed in such a state based on the AC value Iac of the current detecting unit 13, it is highly unlikely to be able to obtain an accurate peak-to-peak voltage value Vpp.

From the above viewpoint, at S217 of FIG. 4B, it is determined whether the difference value ΔIac for each color is less than or equal to ΔIth. ΔIth is a reference value for determining whether the detected AC value Iac is saturated, and is set to the order of several tens of μA. If the determination at S217 is "Y", it is considered that the wastage of the photoconductor drum 5 for a corresponding color proceeds too far, and thus, the CPU 112 turns on the prohibit flag (S226). By this, the determination at S24 of FIG. 4A is not made as "N", and thus, in subsequent processes, too, execution of first charging voltage determination control is prohibited.

Then, the CPU 112 obtains a reference peak-to-peak voltage value Vpp0 (the unit is V) associated with the current number of printed pages which serves as wastage level information Iwst, from a reference value table T4 which is held in advance in the NVRAM 114 or the like (S227). In the reference value table T4, as shown in Table 6, a reference value of a peak-to-peak voltage value Vpp is provided for each range of a total number of printed pages. This reference value table T4 is created in advance by experiment, etc., at a manufacturing stage or a development stage of the image forming apparatus 1. For example, when the number of printed pages is 0 or more and less than 20000, 1300 V is provided as the reference value.

TABLE 6

| Reference value table T4 | | | | | | | | |
|---|---|---|---|---|---|---|---|---|
| | Total number of printed pages (k pages) | | | | | | | |
| Greater than or equal to | 0 | 20 | 40 | 60 | 80 | 100 | 120 | 160 |
| Less than | 20 | 40 | 60 | 80 | 100 | 120 | 160 | 180 |
| Reference value of peak-to-peak voltage value Vpp | 1300 | 1300 | 1300 | 1280 | 1270 | 1250 | 1230 | 1200 |

The reference value of the reference peak-to-peak voltage value Vpp0 obtained at S227 is merely based on the total number of printed pages, and thus, does not always conform to the current temperature and humidity with high accuracy. Hence, the CPU 112 obtains a correction value (the unit is V) associated with the in-device temperature St and the in-device humidity Sh which are obtained at S23, from a correction value table T5 which is held in advance in the NVRAM 114 or the like (S228). In the correction value table T5, as shown in Table 7, a correction value is provided for each combination of a temperature range and a relative humidity range. For example, when the in-device humidity Sh is lower than 20% and the in-device temperature St is 10° C. or higher and lower than 11° C., 100 V is provided as the correction value.

TABLE 7

| Correction value table T5 | | | | | | | | | | | |
|---|---|---|---|---|---|---|---|---|---|---|---|
| | | | Temperature (° C.) At or higher than | | | | | | | | |
| | At or higher than | Lower than | 10 | 11 | 12 | 13 | 15 | 17 | 19 | 22 | 25 |
| | | | Lower than | | | | | | | | |
| | | | 11 | 12 | 13 | 15 | 17 | 19 | 22 | 25 | 28 |
| Relative humidity (%) | | 20 | 100 | 100 | 100 | 100 | 100 | 100 | 100 | 100 | 100 |
| | 20 | 40 | 80 | 80 | 80 | 80 | 80 | 70 | 70 | 50 | 50 |
| | 40 | 60 | 60 | 60 | 50 | 50 | 50 | 50 | 50 | 50 | 30 |
| | 60 | 80 | 40 | 40 | 30 | 30 | 30 | 30 | 30 | 30 | 20 |
| | 80 | | 40 | 40 | 30 | 30 | 30 | 30 | 30 | 30 | 20 |

Then, the CPU 112 adds together each reference peak-to-peak voltage value Vpp0 obtained at S227 and a corresponding correction value obtained at S228, and thereby derives an actual peak-to-peak voltage value Vpp (second charging voltage determination control, S229).

Thereafter, the CPU 112 performs the same process as that at S225. As a result, a charging voltage Vg is applied to each charging unit 6, by which each photoconductor drum 5 is charged.

Finally, S24 of FIG. 4A is referred back. If the determination at S24 is "Y", the CPU 112 considers that execution of first charging voltage determination control is prohibited. Thus, the CPU 112 performs S226 of FIG. 4B and thereby derives actual peak-to-peak voltage values Vpp by second charging voltage determination control.

<<Fourth Section: Functions and Effects of the Image Forming Apparatus>>

As described above, the wastage of the film thickness of the photoconductor drum 5 proceeds, and as a result, it is highly likely that an AC value Iac to be detected by the current detecting unit 13 is inaccurate. Whether such a state is present is determined at S217 of FIG. 4B. If a negative determination is made, first charging voltage determination control is performed, and a peak-to-peak voltage Vpp is derived based on AC values Iac detected by the current detecting unit 13. On the other hand, if a positive determination is made at S217, at S226 the prohibit flag is turned on, by which execution of first charging voltage determination control is prohibited in subsequent processes. Then, a peak-to-peak voltage value Vpp is derived based on a reference value which is derived in advance for each total number of printed pages correlated with wastage level, and a correction value which is derived in advance for each temperature and humidity. Accordingly, the image forming apparatus 1 can be provided that is capable of deriving an appropriate peak-to-peak voltage value Vpp, irrespective of the wastage of the film thickness of the photoconductor drum 5.

Note that in the present embodiment, if the photoconductor drum 5 is replaced with a new one, then the prohibition of first charging voltage determination control is cancelled (FIG. 4A; S21 and S22). Thus, in this case, an appropriate peak-to-peak voltage value Vpp is derived by first charging voltage determination control.

<<Fifth Section: First Variant>>

Figure 9:
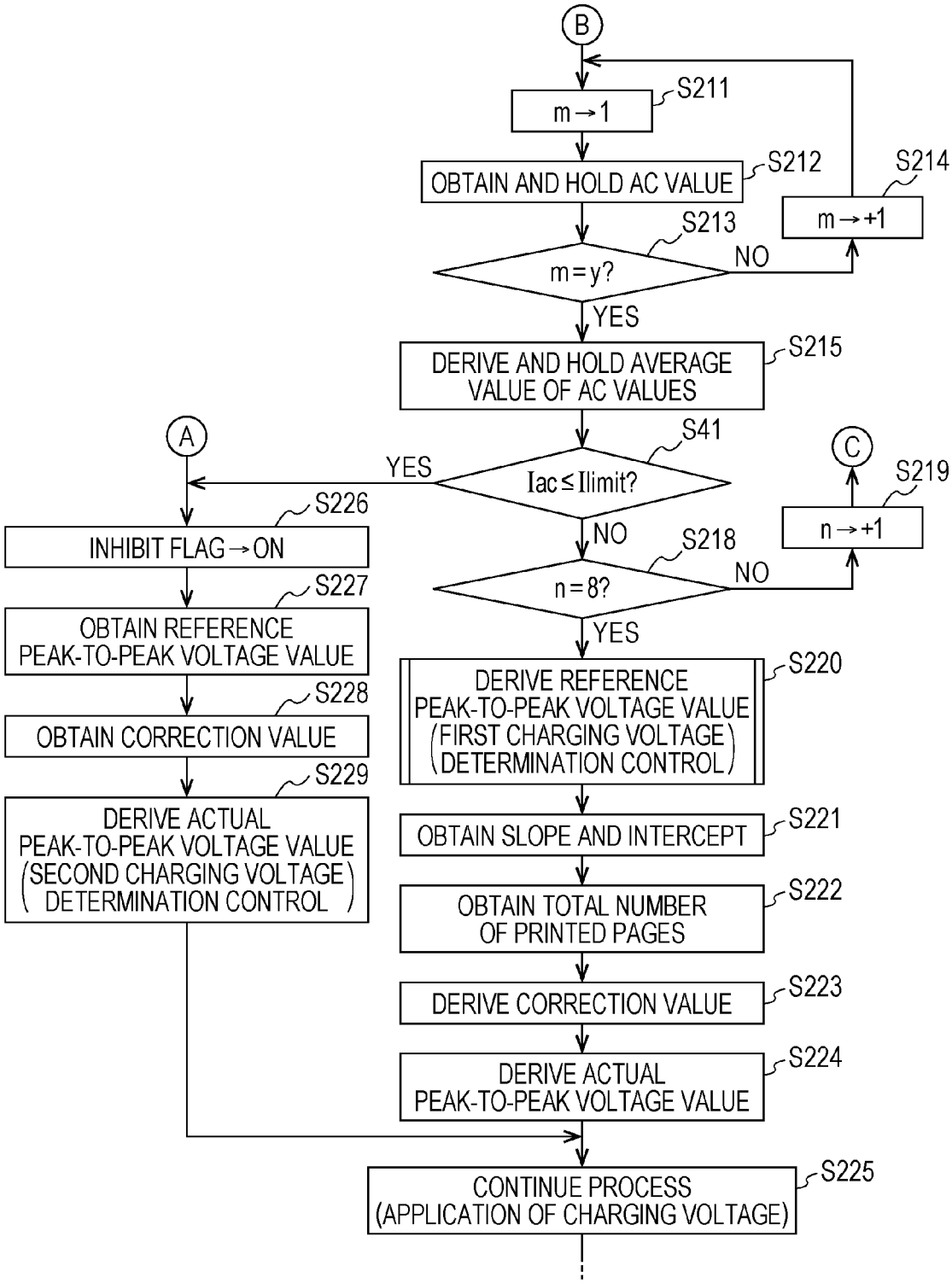
FIG. 9 is a flowchart showing a process performed by the CPU during charging voltage determination control in a first variant.

Next, an image forming apparatus 1 according to a first variant will be described. The first variant differs from the above-described embodiment in that processes shown in FIG. 9 are performed instead of processes in FIG. 4B. FIG. 9 differs from FIG. 4B in that S216 is not performed and that S41 is performed instead of S217. Other than those, there are no differences between the image forming apparatuses 1, and thus, those configurations and steps common between the above-described embodiment and the first variant are denoted by the same reference signs and description thereof is omitted.

At S41, the CPU 112 determines whether an AC value Iac (average value) derived at S215 exceeds an upper limit value Ilimit (e.g., 3066 μA). If the determination is "Y", the CPU 112 performs S226. If the determination is "N", the CPU 112 performs S218.

As described above, when the wastage of the film thickness of the photoconductor drum 5 proceeds too far, an AC value Iac detected by the current detecting unit 13 is, in principle, saturated at the upper limit value Ilimit (see the bottom in FIG. 7), but may unexpectedly exceed the upper limit value Ilimit. In such a case, it cannot be said that the accuracy of the detected AC value Iac is high, and thus, an actual peak-to-peak voltage value Vpp is derived by second charging voltage determination control instead of performing first charging voltage determination control. Accordingly, the image forming apparatus 1 can be provided that is capable of deriving an appropriate peak-to-peak voltage value Vpp, irrespective of the wastage of the film thickness of the photoconductor drum 5.

<<Sixth Section: Second Variant>>

Next, an image forming apparatus 1 according to a second variant will be described.

When a temperature and humidity environment is high temperature and high humidity, the resistance value of the photoconductor drum 5 relatively decreases. Under such high temperature and high humidity, an AC value Iac detected by the current detecting unit 13 tends to increase. As a result, the AC value Iac easily reaches an upper limit value Ilimit. Thus, in the case of a predetermined environmental step indicating high temperature and high humidity (e.g., 16), a more appropriate peak-to-peak voltage value Vpp can be obtained quickly by performing second charging voltage determination control instead of performing first charging voltage determination control.

Figure 10:
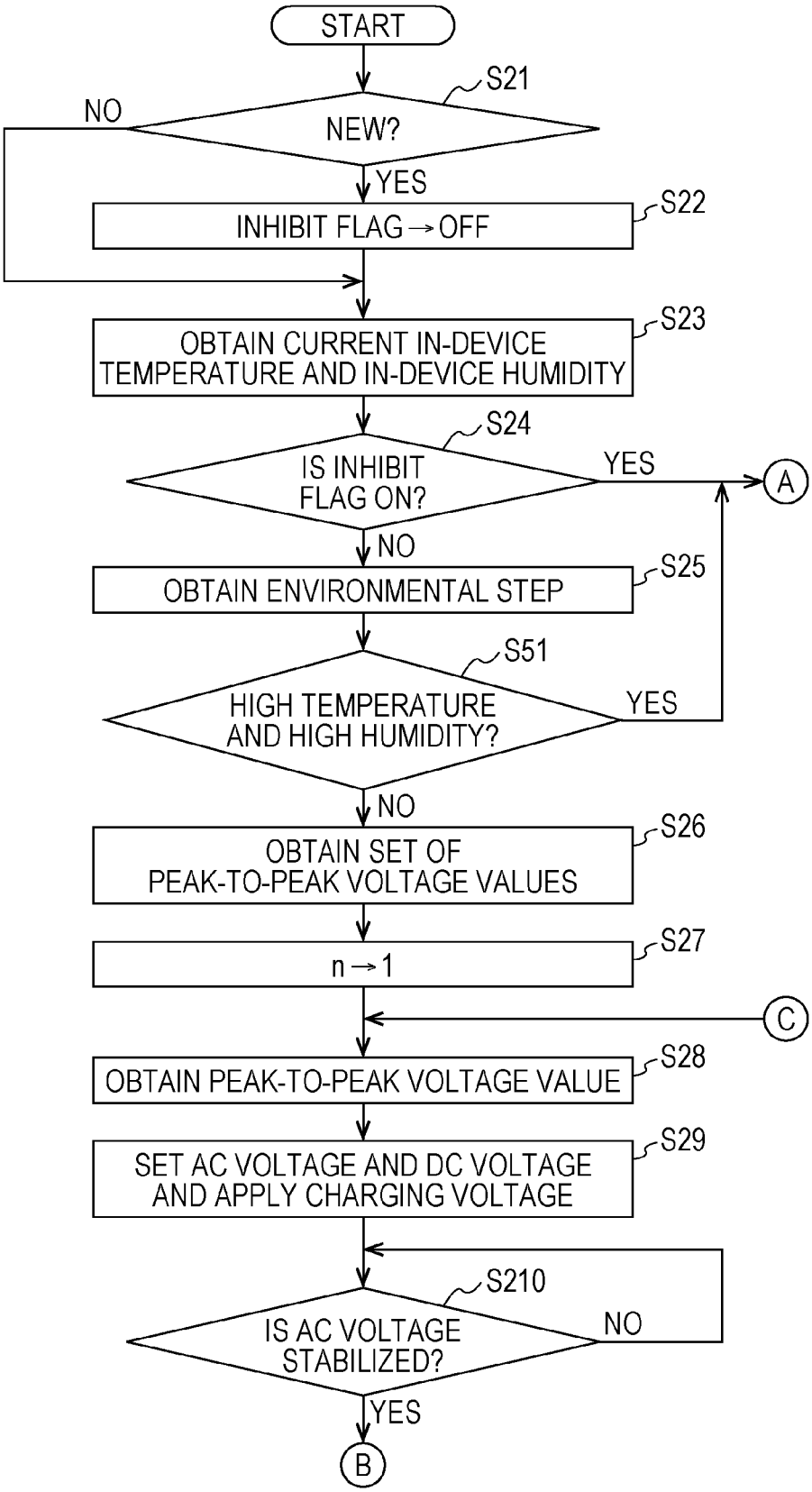
FIG. 10 is a flowchart showing a process performed by the CPU during charging voltage determination control in a second variant.

Hence, the second variant differs from the above-described embodiment in that processes shown in FIG. 10 are performed instead of processes in FIG. 4A. FIG. 10 differs from FIG. 4A in that S51 is performed between S25 and S26. Other than that, there are no differences between the image forming apparatuses 1, and thus, those configurations and steps common between the above-described embodiment and the second variant are denoted by the same reference signs and description thereof is omitted.

At S51, the CPU 112 determines whether an environmental step obtained at S25 is a predetermined environmental step (e.g., 16). If the determination is "Y", the CPU 112 performs S226 to perform second charging voltage determination control. On the other hand, if the determination is "N", the CPU 112 performs S26.

According to the second variant, second charging voltage determination control is immediately performed based on an environmental step obtained at S25. As a result, an appropriate peak-to-peak voltage value Vpp can be derived rapidly.

<<Seventh Section: Third Variant>>

Next, an image forming apparatus 1 according to a third variant will be described.

When the photoconductor drum 5 is nearly end of life, the remaining film thickness becomes small. As a result, the resistance value of the photoconductor drum 5 relatively decreases. In the case of such nearly end of life, an AC value Iac detected by the current detecting unit 13 easily reaches an upper limit value Ilimit. Thus, when the photoconductor drum 5 is nearly end of life, a more appropriate peak-to-peak voltage value Vpp can be obtained quickly by performing second charging voltage determination control instead of performing first charging voltage determination control.

Figure 11:
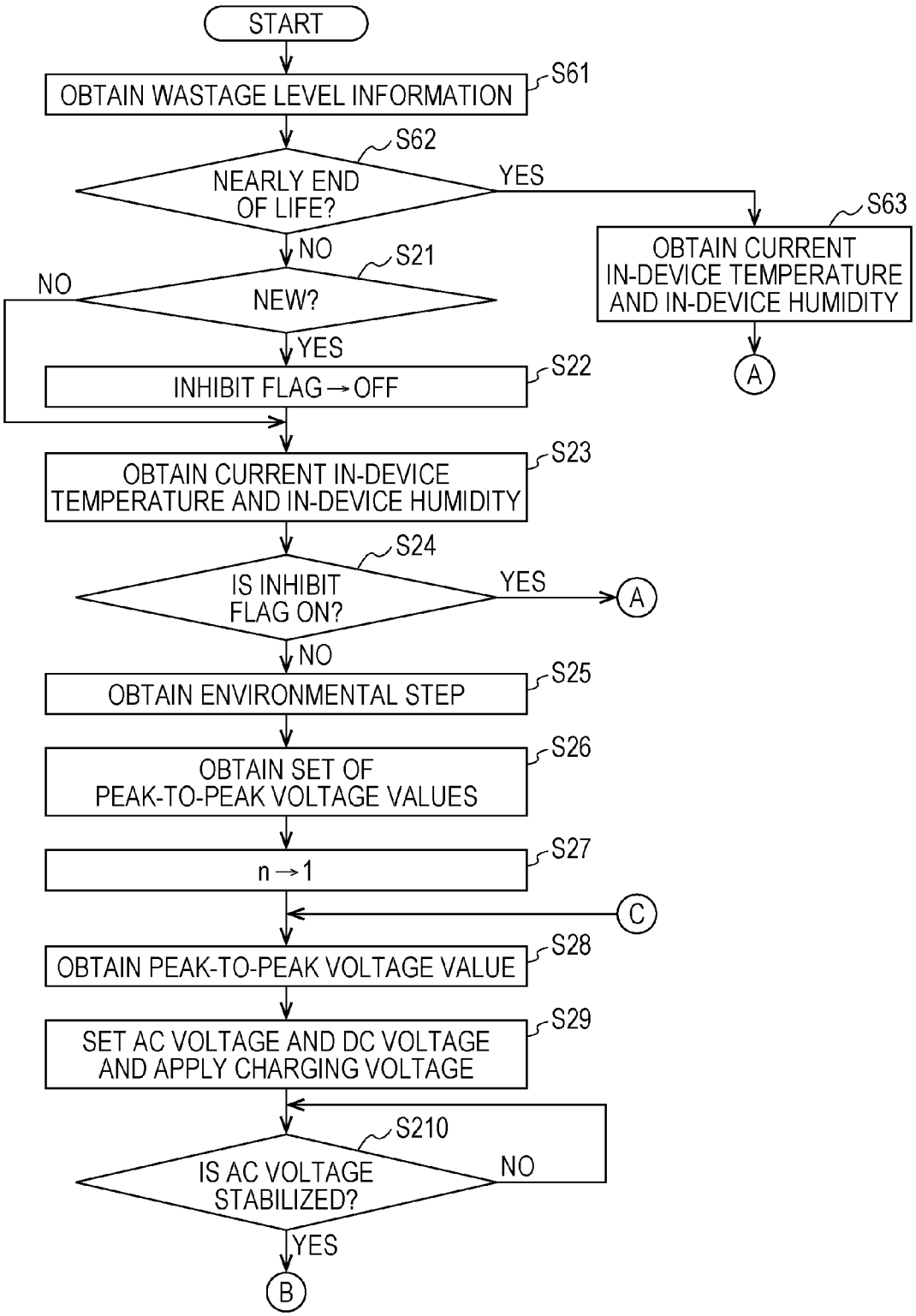
FIG. 11 is a flowchart showing a process performed by the CPU during charging voltage determination control in a third variant.

Hence, the third variant differs from the above-described embodiment in that processes shown in FIG. 11 are performed instead of processes in FIG. 4A. FIG. 11 differs from FIG. 4A in that S61 to S63 are performed before S21. Other than that, there are no differences between the image forming apparatuses 1, and thus, those configurations and steps common between the above-described embodiment and the third variant are denoted by the same reference signs and description thereof is omitted.

At S61, the CPU 112 obtains wastage level information Iwst which is held in the NVRAM 114 or the like, and determines whether a total number of printed pages S is greater than or equal to a threshold value Sth (S62). Here, the threshold value Sth is a total number of printed pages S where the photoconductor drum 5 is nearly end of life, and is derived in advance at design and development stages. If the determination is "Y", the CPU 112 obtains a current in-device temperature St and in-device humidity Sh from the temperature and humidity detecting unit 12 (S63). Thereafter, the CPU 112 performs S226 to perform second charging voltage determination control. On the other hand, if the determination is "N", the CPU 112 performs S21.

According to the third variant, when the photoconductor drum 5 is nearly end of life, second charging voltage determination control is performed immediately. As a result, an appropriate peak-to-peak voltage value Vpp can be derived rapidly.

<<Fifth Section: Additional Notes>>

In the description of the above-described embodiment, the image forming apparatus 1 includes, for each color, the current detecting unit 13. However, the configuration is not limited thereto, and the current detecting unit 13 may be provided only to charging unit(s) 6 for one to three specific colors that represent(s) all colors.

In addition, the CPU 112 derives a correction value based on current environmental conditions (in-device temperature St and in-device humidity Sh) at S228 of FIG. 4B, etc. However, when the temperature and humidity detecting unit 12 includes an absolute humidity sensor, the CPU 112 may derive a correction value based on an absolute humidity. In addition, the correction value table T5 may be created based on only one of temperature and relative humidity.

An image forming apparatus according to an embodiment of the present invention can derive an appropriate AC peak-to-peak voltage value, irrespective of ambient temperature or the film thickness of a photoconductor. Thus, the image forming apparatus is suitable for a facsimile, a copying machine, a printer, and a multifunctional peripheral having those functions, regardless of whether it is a color machine or a monochrome machine.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus that forms an image on a medium when the medium is fed through the apparatus, the image forming apparatus comprising:

an image carrying member;

a charging unit disposed in proximity to the image carrying member;

a power supply unit configured to sequentially apply a plurality of charging voltages to the charging unit when the medium is not fed through, the plurality of charging voltages including AC voltages, respectively, and the AC voltages having different peak-to-peak voltages;

a current detecting unit configured to detect an AC value flowing through the charging unit during the application of each of the plurality of charging voltages;

a processing unit configured to perform first charging voltage determination control to derive a first peak-to-peak voltage value to be used in a process, based on the AC values detected by the current detecting unit; and a storage unit configured to pre-store a reference peak-to-peak voltage value for each wastage level of the image carrying member, wherein the processing unit:

prohibits execution of the first charging voltage determination control according to at least one AC value obtained from the current detecting unit, and performs second charging voltage determination control; and in the second charging voltage determination control, obtains a reference peak-to-peak voltage value associated with a current wastage level of the image carrying member from the storage unit, and derives a second peak-to-peak voltage value to be used in the process, based on the obtained reference peak-to-peak voltage value.

2. The image forming apparatus according to claim 1, wherein when a difference value between an AC value obtained from the current detecting unit at a second time and an AC value obtained from the current detecting unit at a previous first time is less than or equal to a predetermined threshold value, the execution of the first charging voltage determination control is prohibited, and the second charging voltage determination control is performed.

3. The image forming apparatus according to claim 1, wherein when any of the AC values obtained from the current detecting unit exceeds a predetermined threshold value, the execution of the first charging voltage determination control is inhibited, and the second charging voltage determination control is performed.

4. The image forming apparatus according to claim 1, wherein the storage unit further pre-stores, for each ambient temperature and/or ambient humidity, correction values for the reference peak-to-peak voltage values, and in the second charging voltage determination control, the processing unit obtains, from the storage unit, the reference peak-to-peak voltage value associated with the current wastage level of the image carrying member, and a correction value associated with a current ambient temperature and/or a current ambient humidity, to derive the second peak-to-peak voltage value to be used in the process.

5. The image forming apparatus according to claim 1, wherein when a current temperature and humidity are a predetermined high-temperature and high-humidity state, the first charging voltage determination control is not performed, but the second charging voltage determination control is performed.

6. The image forming apparatus according to claim 1, wherein when the image carrying member is nearly end of life, the first charging voltage determination control is not performed, but the second charging voltage determination control is performed.

7. The image forming apparatus according to claim 1, wherein in the first charging voltage determination control, the processing unit derives, as a derived reference peak-to-peak voltage value, an intersection point of characteristic line of AC values with respect to AC voltages in a forward discharge region and characteristic line of AC values with respect to AC voltages in a reverse discharge region.

8. The image forming apparatus according to claim 7, wherein the processing unit corrects the derived reference peak-to-peak voltage value based on at least one of the wastage level of the image carrying member, ambient temperature, and ambient humidity, and uses the corrected reference peak-to-peak voltage value as the first peak-to-peak voltage to be used in the process.

9. The image forming apparatus according to claim 1, wherein when the image carrying member is replaced with a new one, the processing unit cancels the prohibition of the execution of the first charging voltage determination control.

* * * * *